US005899776A

United States Patent [19]

Tseng

[11] Patent Number: 5,899,776

[45] Date of Patent: May 4, 1999

[54] MECHANISM FOR RETAINING CONTACTS IN CONNECTOR

[75] Inventor: Green Tseng, Taipei Hsien, Taiwan

[73] Assignee: Hon Hai Precision Ind. Co., Ltd., Taipei Hsien, Taiwan

[21] Appl. No.: 08/761,536

[22] Filed: Dec. 6, 1996

[51] Int. Cl.[6] ..... H01R 13/514

[52] U.S. Cl. ..... 439/752

[58] Field of Search ..... 439/752, 752.5, 439/607, 610

[56] References Cited

U.S. PATENT DOCUMENTS 4,557,543 12/1985 McCleerey et al. ..... 439/752.5 X
5,190,481 3/1993 Ju ..... 439/752 X
5,613,879 3/1997 Fonteneau et al. ..... 439/607 OR
5,630,736 5/1997 Yagi et al. ..... 439/752 OR

*Primary Examiner*—Paula Bradley
*Assistant Examiner*—Daniel Wittels

[57] ABSTRACT

An electrical connector (30) comprises a main housing (32) consisting of an island section (34) and a pressing block (36) wherein the island section (34) defines a plurality of passageways (38) for receiving a corresponding number of socket type contacts (40) therein and each passageway (38) defines an alignment slot (42) therein. A plurality of retention devices (46) are disposed on the front surface of the pressing block (36) for alignment with the corresponding passageways (38), respectively. A pair of boardlocks (56) are positioned at two opposite ends of the pressing block (36) and a pair of rivets (54) are attached thereabouts for securing a shell (50) to the pressing block (36).

5 Claims, 5 Drawing Sheets

MECHANISM FOR RETAINING CONTACTS IN CONNECTOR

BACKGROUND OF THE INVENTION

1. Field of the Invention

The invention relates to electrical connector assembly, and particularly to structures adapted to retain socket type contacts within the connector housing.

2. The Related Art

As shown in FIG. 1, the female connector 10 having socket type contacts therein, generally includes a main housing 11 consisting of an island portion 12 and a base portion 13 commonly defining a plurality of passageways 14 for receiving a correspond number of socket type contacts 15 therein. A pressing plate 16 is attached to the rear portion of the housing 11 for abutment with the tail sections 17 of the contacts 15 so as to retain the contacts 15 in the housing 11 and aligning the tail sections 17 of the contacts with regard to the holes in the PC board (not shown) on which the connector 10 is mounted. The connector 10 further includes a shell 18 attached to the housing 11 with a pair of boardlocks 19 fastened to the housing 11 by a pair of rivets 20.

One problem of the aforementioned prior art connector 10 is that because the socket type contact requires more material to form its own socket configuration for receiving a pin type counterpart male contact therein and for cooperation with the pressing plate 16 for retention, the pitch (5.54 mm) of contacts 15 along the continuous raw strip 21 is substantially twice to the pitch (2.27 mm) of the passageways 14 in the housing 11. In other words, each row of passageways 14 requires two times installation of the contacts 15 associated with their carrier strips 21 wherein one is for the odd number passageways 14 and the other is for the even number passageways 14. The disadvantages of this double pitch arrangement of the strip 21 with regard to the corresponding passageways 14 includes wasting material and taking more assembling time and labor. U.S. Pat. No. 5,183,241, which has the same assignee with the invention, discloses a specific type socket type contact which meets the same pitch arrangement along the continuous strip with the passageway, while such shape makes it difficult to manufacture the contacts.

Therefore, an object of the invention is to provide an electrical connector assembly having therein a plurality of socket type contacts wherein the pitch arrangement of contacts along the strip is same as that of the passageways along each row.

SUMMARY OF THE INVENTION

According to an aspect of the invention, an electrical connector comprises a main housing consisting of an island section and a pressing block wherein the island section defines a plurality of passageways for receiving a corresponding number of socket type contacts therein and each passageway defines an alignment slot therein. A plurality of retention devices are disposed on the front surface of the pressing block for alignment with the corresponding passageways, respectively. A pair of boardlocks are positioned at two opposite ends of the pressing block and a pair of rivets are attached thereabouts for securing a shell to the pressing block.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
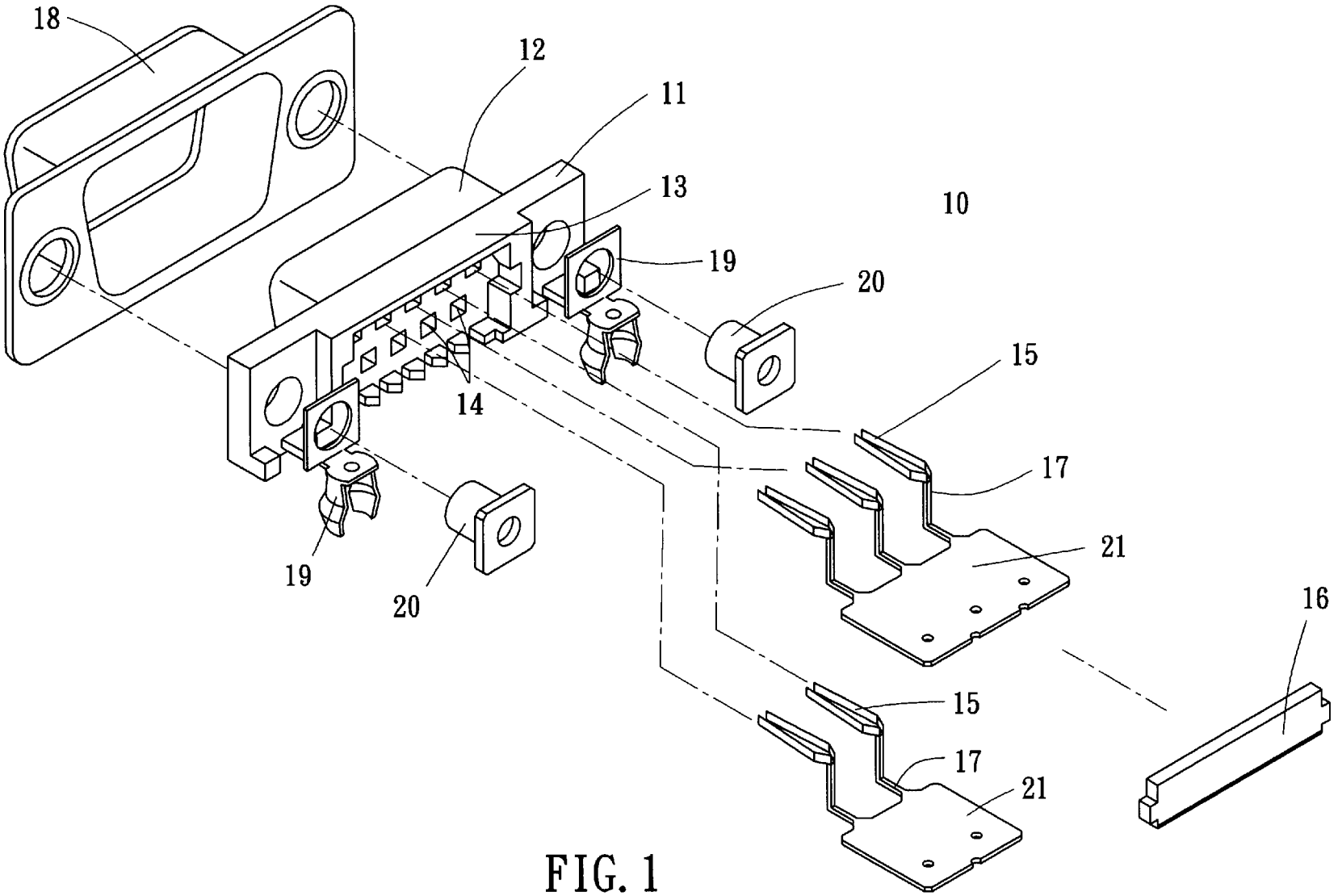
FIG. 1 PRIOR ART
FIG. 1 is an exploded perspective view of a prior art female connector with the upper row socket type contacts and their associated strip aside.
Figure 2A:
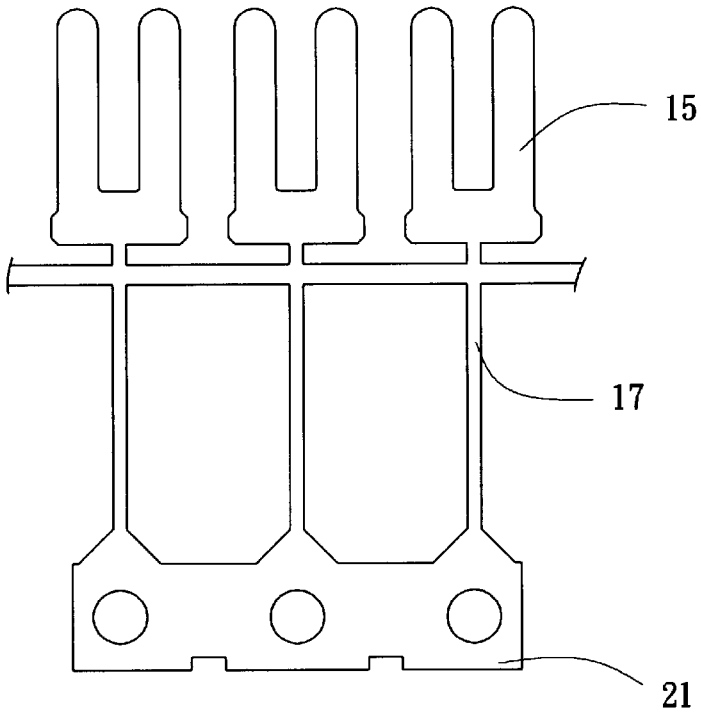
FIG. 2A PRIOR ART
FIG. 2(A) is a plan view of an extended contact strip for use with the contacts and the connector of FIG. 1.
Figure 2B:
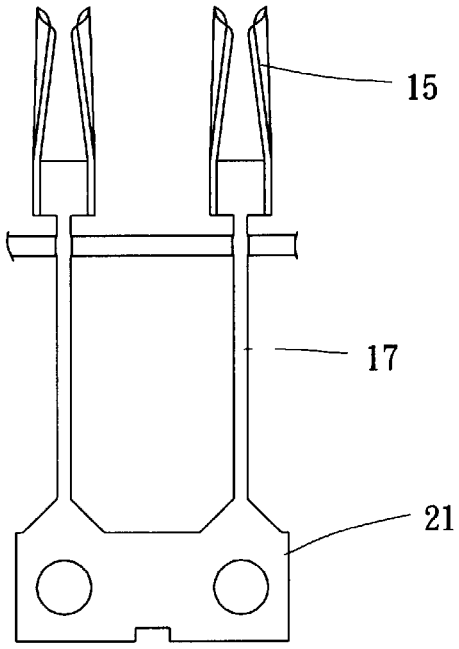
FIG. 2B PRIOR ART
FIG. 2(B) is a plan view of the contact strip of FIG. 2(A) after the contacts have been formed to their final shape.
Figure 3:
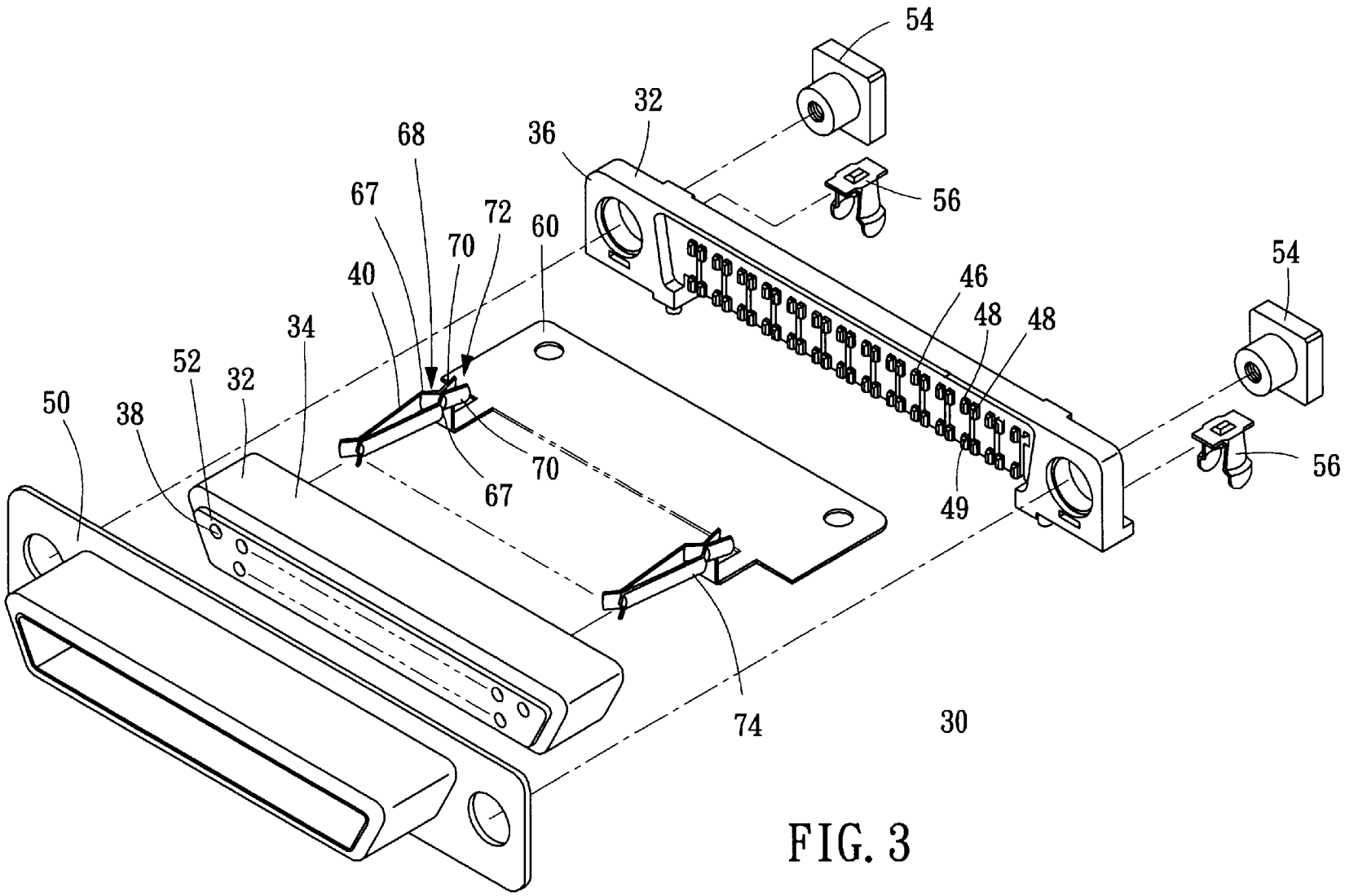
FIG. 3 is an exploded perspective view of a presently preferred embodiment of the female connector having socket type contacts therein, according to the invention.
Figure 4A:
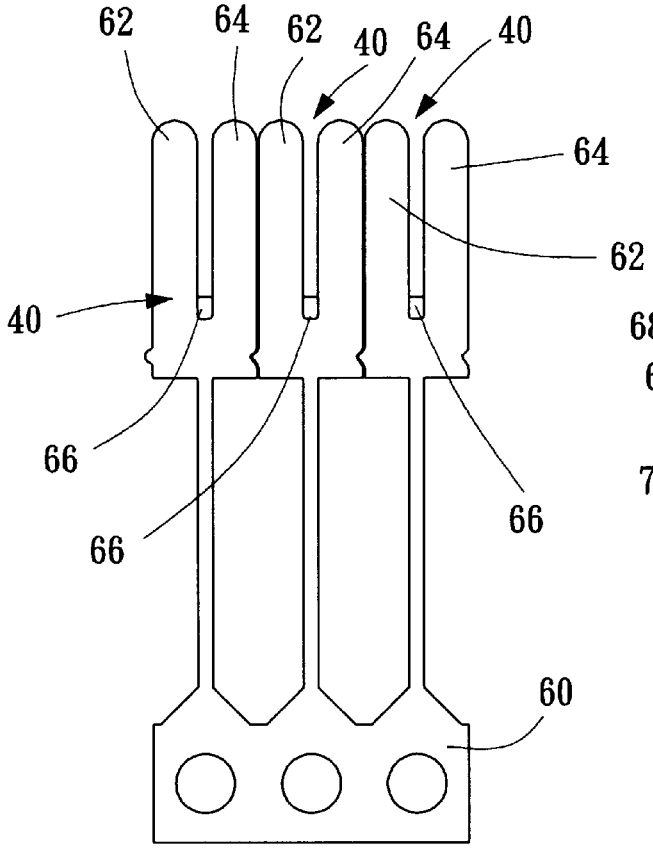
FIG. 4(A) is a plan view of the extended contact strip for use with the contact and the connector of FIG. 3.
Figure 4B:
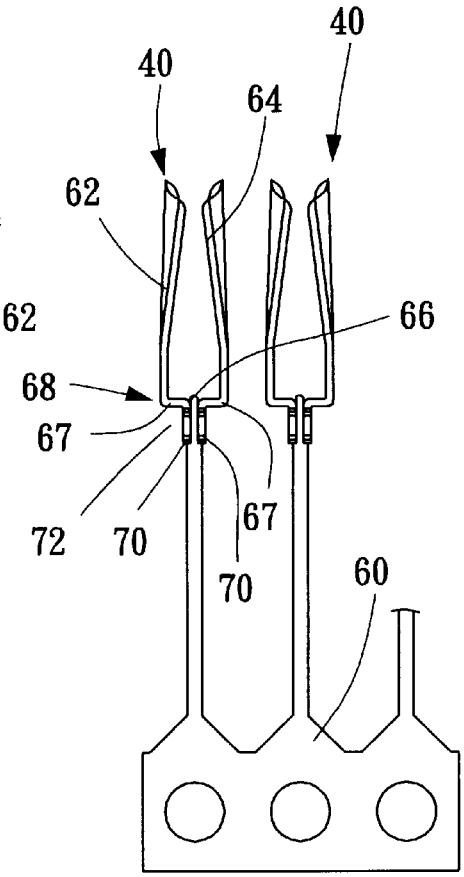
FIG. 4(B) is a plan view of the formed contact strip of FIG. 4(A).
Figure 5:
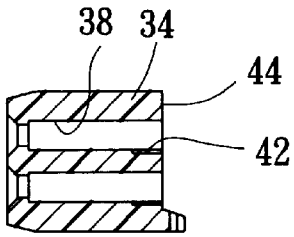
FIG. 5 is a cross-sectional view of the island section of the main housing of FIG. 3 to show the retention slots therein.

It will be noted here that for a better understanding, most of like components are designated by like reference numerals throughout the various figures in the embodiments. Attention is directed to FIGS. 3, 4(A), 4(B) and 5, wherein an electrical female connector 30 includes a main housing 32 consisting of a island section 34 and a pressing block 36. A plurality of passageways 38 are disposed in the island section 34 for receiving a corresponding number of socket type contacts 40 therein.

Each passageway 38 includes an alignment slot 42 formed adjacent to the rear surface 44 of the island section 34. A plurality of retention devices 46 of the pressing block 36 are formed in alignment with the corresponding passageways 38, respectively, and each of retention devices includes a pair of abutment protrusions 48. A tail receiving slot 49 is formed between each pair of abutment protrusions 48.

A shell 50 is attached to the front surface 52 of the pressing block 36 by means of a pair of fastening rivets 54, and enclosing the island section 34 therein. A pair of boardlocks 56 are installed at two opposite ends of the pressing block 36 for mounting the connector 30 on a PC board (not shown).

Figure 6A:
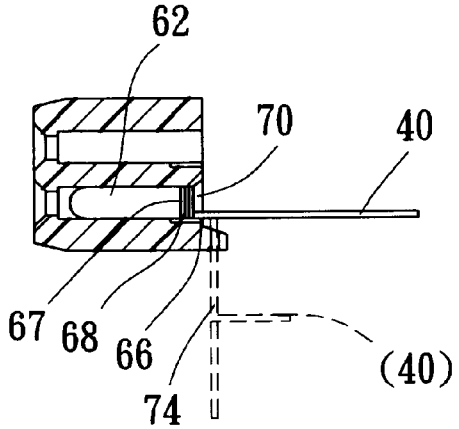
FIG. 6(A) is a vertical cross-sectional view of the island section of the main housing with the contacts of FIG. 3 to show how the contact can be received within the corresponding passageway.
Figure 6B:
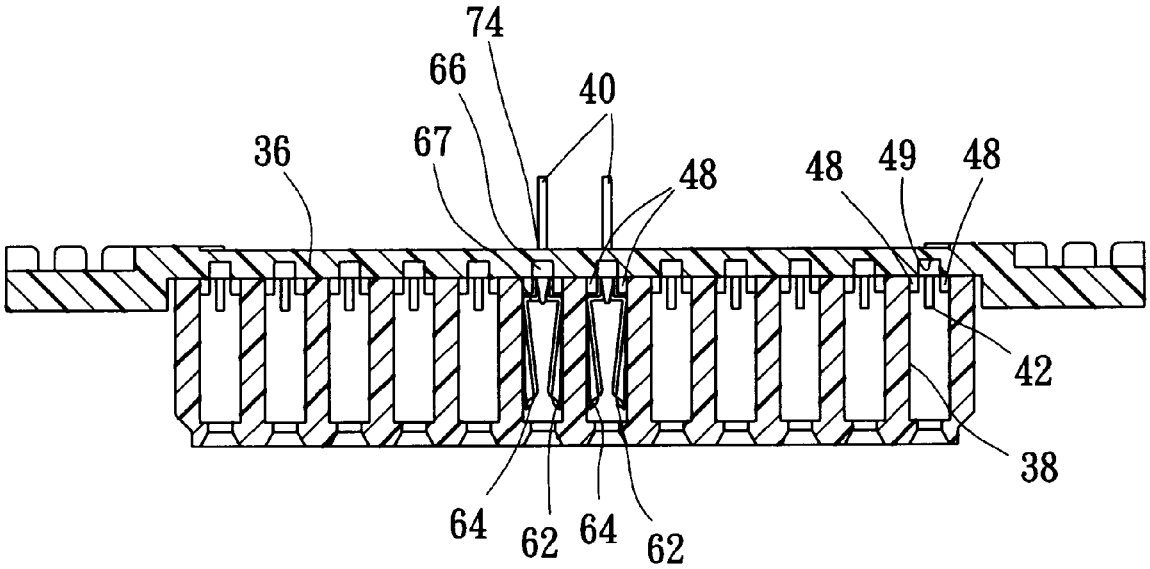
FIG. 6(B) is a horizontal cross-sectional view of the island section of the main housing with the contacts of FIG. 3 to show how the contact can be received within the corresponding passageway.

The contact strip 60 includes a plurality of contacts 40 spaced with each other in the same pitch arrangement with the adjacent passageways 38 in the housing 32. Referring to FIGS. 4(A)–6(B), the unfolded or extended adjacent contacts 40 are arranged to be close to each other and each includes a first arms 62 and a second arm 64 commonly extending from a center alignment section 66 which is adapted to be received within the alignment slot 42 in the corresponding passageway 38. Each arm 62, 64 includes a laterally projecting section 67 to cooperate with each other for forming a neck section 68 thereof, and a vertical retention wall 70 to cooperate with each other and the alignment section 66 for forming a U-shaped unit 72. Therefore, when the contact 40 is received within the corresponding passageway 38 in the housing 32, the alignment section 66 is snugly received within the alignment slot 42, and the pair of neck sections 68 and the pair of vertical retention walls 70 of the contact 40 are pressed against the abutment protrusions 48 of the pressing block 36 which extend forward from the pressing block 36 and into the corresponding passageway 38. The right-angle bent tail section 74 of the contact 40 can be received within the tail receiving slot 49 in the pressing block 36.

It is noted that based on the structures of the contacts 40, the contact strip 60 can be arranged to in the same pitch with the passageways 38. The structure of each contact 38 is simple to manufacture and be able to cooperate with the abutment protrusions 48 projecting into the passageway 38 for retention of the contact 40 within the housing 32.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

I claim:

1. A electrical connector comprising:

a main housing including an island section and a pressing block;

a plurality of passageways disposed in the island section for receiving a corresponding number of contacts therein;

an alignment slot formed in each of the passageways adjacent to a rear portion of the island section;

a plurality of retention devices formed on a front surface of the pressing block and in alignment with the corresponding passageways, respectively, for being adapted to project thereunto; and each of said contacts including an alignment section for reception within the alignment slot in the corresponding passageway, and a pair of arms respectively forming neck sections and wall sections for engagement with the corresponding retention device projecting into the corresponding passageway.

2. The connector as defined in claim 1, wherein the retention device comprises a pair of abutment protrusions and a tail receiving slot is formed between said pair of abutment protrusions.

3. The connector as defined in claim 1, wherein said connector further includes a shell fastened to the pressing block by a pair of rivets, and a pair of boardlocks are attached to two opposite ends of the pressing block.

4. A contact for use with a female connector which comprises a main housing including an island section and a pressing block wherein the island section defines a plurality of passageways for receiving a corresponding number of contacts therein, and each of said passageways includes an alignment slot thereabouts, and the pressing block includes a plurality of retention devices in alignment with the corresponding passageways, respectively, each of said contacts comprising:

a pair of arms integrally and respectively extending from an alignment section which is adapted to be received within the alignment slot in the corresponding passageway, and each of said arms including a laterally projecting section and a vertical retention wall section commonly for engagement with the corresponding retention device of the pressing block.

5. A contact strip including a plurality of formed contacts thereon for use with a female connector defining a first pitch arrangement of a row of passageways thereof; said contact strip defines a second pitch arrangement of a row of contacts thereof wherein the first pitch arrangement is equal to the second pitch arrangement, and each of contacts including a pair of arms integrally respectively extending from an alignment section and each of said arms including a laterally projecting section and a vertical retention wall section wherein the retention wall sections of said pair of arms face to each other, and the laterally projecting sections of said pair of arms extending laterally away from each other.

* * * * *